US005605185A

United States Patent [19]

McKeon

[11] Patent Number: 5,605,185

[45] Date of Patent: Feb. 25, 1997

[54] FIRE DOOR SYSTEM

[75] Inventor: James M. McKeon, Brooklyn, N.Y.

[73] Assignee: McKeon Rolling Steel Door Co., Inc., Brooklyn, N.Y.

[21] Appl. No.: 327,188

[22] Filed: Oct. 21, 1994

[51] Int. Cl.[6] ..... E05F 15/20

[52] U.S. Cl. ..... 160/1; 160/133; 160/120; 52/1; 49/95; 49/118

[58] Field of Search ..... 52/1; 49/95, 118; 160/1, 6, 7, 120, 133

[56] References Cited

U.S. PATENT DOCUMENTS

| | | | |
|---|---|---|---|
| 957,923 | 5/1910 | Wilson | 160/1 X |
| 1,062,997 | 5/1913 | Stanish | 49/95 |
| 1,151,388 | 8/1915 | Pond | 49/95 |
| 1,255,817 | 2/1918 | Gibson et al. | 160/120 X |
| 1,369,518 | 2/1921 | Bumbarger | 160/1 |
| 1,478,601 | 12/1923 | Davis | 49/118 X |
| 1,708,377 | 4/1929 | Cornell | 160/120 X |
| 1,740,877 | 12/1929 | Sharp | 49/118 X |
| 1,871,095 | 8/1932 | Tomkinson | 49/95 X |
| 1,891,051 | 12/1932 | Neese | 49/118 X |
| 2,252,172 | 8/1941 | Galeazi | 49/118 X |
| 3,350,819 | 11/1967 | Polidoro et al. | 52/1 |
| 3,461,607 | 8/1969 | Sandow et al. | 52/1 X |
| 3,687,185 | 8/1972 | Singer | 160/1 |
| 3,877,525 | 4/1975 | Husson et al. | 160/1 X |
| 4,020,889 | 5/1977 | Karoll | 160/120 |
| 4,501,963 | 2/1985 | Perisic | 160/1 X |
| 4,664,170 | 5/1987 | Labelle | 160/133 |
| 5,203,392 | 4/1993 | Shea | 160/133 X |
| 5,207,259 | 5/1993 | Sheperd et al. | 160/133 |
| 5,228,492 | 7/1993 | Jou | 160/3 X |
| 5,245,879 | 9/1993 | McKeon . | |
| 5,386,891 | 2/1995 | Shea | 160/7 X |
| 5,482,103 | 1/1996 | Burgess et al. | 160/7 X |

FOREIGN PATENT DOCUMENTS

| | | | |
|---|---|---|---|
| 87806 | 9/1983 | European Pat. Off. | 160/120 |
| 130859 | 3/1929 | Switzerland | 160/120 |

*Primary Examiner*—Wynn E. Wood
*Assistant Examiner*—Aimee E. McTigue
*Attorney, Agent, or Firm*—Cohen, Pontani, Lieberman, Pavane

[57] ABSTRACT

A fire door system comprising first and second fire door assemblies each assembly including a fire door, a temperature sensing device and an operator. The operators of each of the assemblies are electrically interconnected such that when the fire doors simultaneously close when either (a) the temperature sensing device senses that the ambient temperature exceeds a predetermined value or (b) the circuit between the operators of the assemblies is deactivated.

13 Claims, 6 Drawing Sheets

FIRE DOOR SYSTEM

FIELD OF THE INVENTION

The present invention relates to a fire door system for simultaneously closing at least two retractable fire doors.

BACKGROUND OF THE INVENTION

Door systems to control the lowering of doors in emergency conditions have been used for many years. Among the doors so controlled are fire doors including fire doors of the type comprising a plurality of horizontal slats pivotally connected to one another to enable the fire door to be reeled in when raised and unreeled when lowered. There are numerous prior art mechanisms known and used for raising such fire doors to the normal or non-emergency conditions and for lowering the doors during a fire. In such operating mechanisms, an electric motor is commonly used to raise the door to an open locked position. When a fire occurs, these operating mechanisms disengage the motor from the fire door and allow the door to close either under the urging of an auxiliary spring activated by mechanical means or by gravitational surpassing the force exerted on the door by a torsional spring counter balancing mechanism.

Conventional rolling steel fire doors are usually utilized in pairs so that one fire door closes an opening in a wall on one side of the wall and the other fire door closes the same opening on the other side of the wall. Most importantly, it is usually required under local fire codes that the two retractable fire doors close simultaneously. To simultaneously close the two fire doors, previously known fire door systems connect the pair of doors with a sash chain which passes through an aperture in the wall. The sash chain has one or more links comprised of two pieces of metal held together by low melting-point solder. When the solder in any one of the fusible links melts, such as when the ambient temperature reaches or surpasses a predetermined value, the links separate or break, thereby releasing the tension on the sash chain on both sides of the wall opening. With this tension removed, a compression spring on each door assembly releases a plunger which in turn disengages a brake which keeps the rolling fire doors locked in their open positions. Accordingly, both steel fire doors simultaneously close, due to the force of gravity. However, as is evident, a typical problem with this through-the-wall sash chain connection method is that the links or the sash chain can become ensnared in the aperture through the wall. Additionally, if the chains are mistakenly painted or become entangled in various proximate structures, either or both of the doors may not properly close in the event of a fire.

An additional drawback of such fire door systems is evident when more than two doors at more than one opening are to operate together. For example, when a building is provided with more than one opening, and if all the pairs of doors at the various openings are to drop simultaneously on the breaking of a single fusible link, a chain must be run through the wall from one door to the next. When the fire doors of more than two openings are to operate jointly, it can be readily seen that the chain configuration can easily become complex, cumbersome and impractical and, thereby be subject to interference and malfunction, with the end result being that the fire doors do not properly close when required.

SUMMARY OF THE INVENTION

It is therefore an object of the invention to provide a fire door system in which in the event of fire or deactivation of the circuit controlling the system, all of the fire doors controlled by the system simultaneously close.

Another object of the invention is to provide at least one temperature sensing means at each fire door wherein when one of the temperature sensing means senses that the ambient temperature exceeds a predetermined value, all of the fire doors controlled by the system simultaneously close.

A further object of the invention is to provide a circuit for connecting all of the microswitches of each operator of each fire door assembly such that when the fire doors are open, the fire doors simultaneously close when one microswitch is activated.

Still another object of the invention is to provide an operator which comprises a plunger and a microswitch wherein the plunger is biased in a first non-contact position with the microswitch by the tensioning of a sash chain which is attached to the wall or ceiling and is positionable in a second contact position with the microswitch when the temperature sensing means senses that the ambient temperature exceeds a predetermined value. When this occurs, the tension in the sash chain is released thus allowing the plunger to be biased in the second contact position thereby deactivating the circuit between the microswitches and thus the solenoids of the other fire doors, thus allowing all of the fire doors to close simultaneously under the force of gravity.

Yet another object of the invention is to provide a means for deactivating the circuit at a location remote from the fire door assemblies allowing all fire doors to close simultaneously for testing the circuit.

Another object of the invention is to provide a fire door system which eliminates through-the-wall sash chain connections thereby eliminating the problems associated with this method such as the sash chain becoming ensnared in the through-the-wall aperture which prevents either or both of the fire doors from properly closing in the event of a fire.

A further object of the invention is to provide simultaneous activation of all fire doors on the activation of one fusible link where a building is provided with more than one opening.

The present invention is thus directed to a fire door system for simultaneously closing at least two retractable fire doors. One such fire door is shown in U.S. Pat. No. 5,203,392, the entire disclosure of which is incorporated herein by reference.

As illustrated, the fire door system constructed in accordance with the present invention is utilized for building wall openings in which a first fire door assembly is mounted at the first side of the opening for raising and lowering a first fire door and in which a second fire door assembly is mounted at the second side opening for raising and lowering a second fire door.

Each fire door assembly comprises a fire door, a temperature sensing means which is connected to the fire door and a releasing mechanism which is connected to the temperature sensing means. For example, the releasing mechanism may include an operator comprising a plunger and microswitch. In accordance with the present invention, circuit means interconnects the microswitches of each fire door assembly such that when the fire doors are in an open, retracted position, the fire doors simultaneously move to a closed position when either (a) the temperature sensing means of any of the fire door assemblies senses that the ambient temperature exceeds a predetermined value or (b) the circuit between the operators of the fire door assemblies is deactivated. Accordingly, upon interruption of the circuit by the plunger of the operator which contacts the microswitch to deactivate the circuit, power throughout the entire circuit is deactivated. As such, the solenoids of each releasing mechanism associated with each fire door on either side of the opening are simultaneously closed.

Specifically, when the door is in an open position, the plunger is biased in a first non-contact position with the microswitch by the tensioning of a sash chain which is attached to the wall or ceiling. As well, the plunger is positionable in a second contact position with the microswitch when the temperature sensing means senses that the ambient temperature exceeds a predetermined value. When the plunger is in the second contact position, the circuit between the operators is deactivated, thus deactivating each of the solenoids of the releasing mechanisms of each fire door simultaneously allowing all of the fire doors to close under the force of gravity when the brake in the regulating mechanism is disengaged.

Additionally, a test panel which uses a high voltage 220 volt transformer connected to a diode is provided so that all the doors at each opening may be tested, i.e. closed, from a single location. The test panel converts the high voltage 220 volt input into a 24 volt DC output which is sent to each of the fire door operators. If the 24 volt DC signal is interrupted, i.e. power outage, alarm or by activation of the microswitch, all the doors which receive the signal would close under gravity.

As is contemplated by the invention, any number of doors may be connected in order to comprise the fire door system. For example, two, three, four or five doors may be utilized as long as each door has associated with it a temperature sensing means and an operator and is connected to the circuit means. So that all the doors may close simultaneously, the circuit means preferably connects each microswitch in series although each microswitch may be connected in parallel.

Referring to the operation of the fire door system, all the doors associated with the circuit may be closed when either (a) any of the temperature sensing means on any of the doors senses that the ambient temperature exceeds a predetermined value or (b) the circuit between any of the operators is deactivated. For example, when utilizing a fire door system utilizing four doors, if the temperature sensing means for the third door senses that the ambient temperature exceeds a predetermined value, i.e. melts, this causes the tension in the sash chain to no longer bias the plunger in its first non-contact position. With this tension removed, a compression spring releases the plunger to engage the microswitch and the lever, thus disengaging the brake (84), as shown in FIG. 4 of the '392 patent, allowing door number 3 to close. Most importantly, when the microswitch of door number 3 is activated, the circuit between each microswitch of the other doors is deactivated, thus deactivating the solenoids of door number 1, 2 and 4 and allowing each fire door to close.

As well, utilizing this four door, two wall opening configuration, if the 24 volt DC signal is interrupted, i.e. power outage, alarm or by manual on/off switch, all the doors which receive the signal would close under gravity.

The temperature sensing means may be in the form of a fusible link or the like. The fusible link as shown comprises two pieces of metal held together by a low melting-point solder. While the fusible link is intact, the sash chain pulls the plunger of the operator to compress a compression spring at one end of the plunger to prevent the plunger from contacting the microswitch and the lever. When the ambient temperature surrounding the fire door reaches a predetermined value, the low melting-point solder melts and the fusible link separates, releasing the tension on the sash chain. With this tension removed, the compression spring releases the plunger to engage the microswitch thus interrupting power throughout the circuit as well as to engage the lever disengaging the brake for that particular fire door.

These and other objects and features of the present invention will become apparent from the following detailed description considered in conjunction with the accompanying drawings. It is to be understood, however, that the drawings are designed solely for purpose of illustration and not as a definition of the limits of the invention, for which reference should be made to the appended claims.

BRIEF DESCRIPTION OF THE DRAWINGS

The present invention will be explained in further detail with reference to the appended drawings, in which like reference numerals delineate similar elements throughout the several views.

DETAILED DESCRIPTION OF THE PRESENTLY PREFERRED EMBODIMENTS

Figure 1:
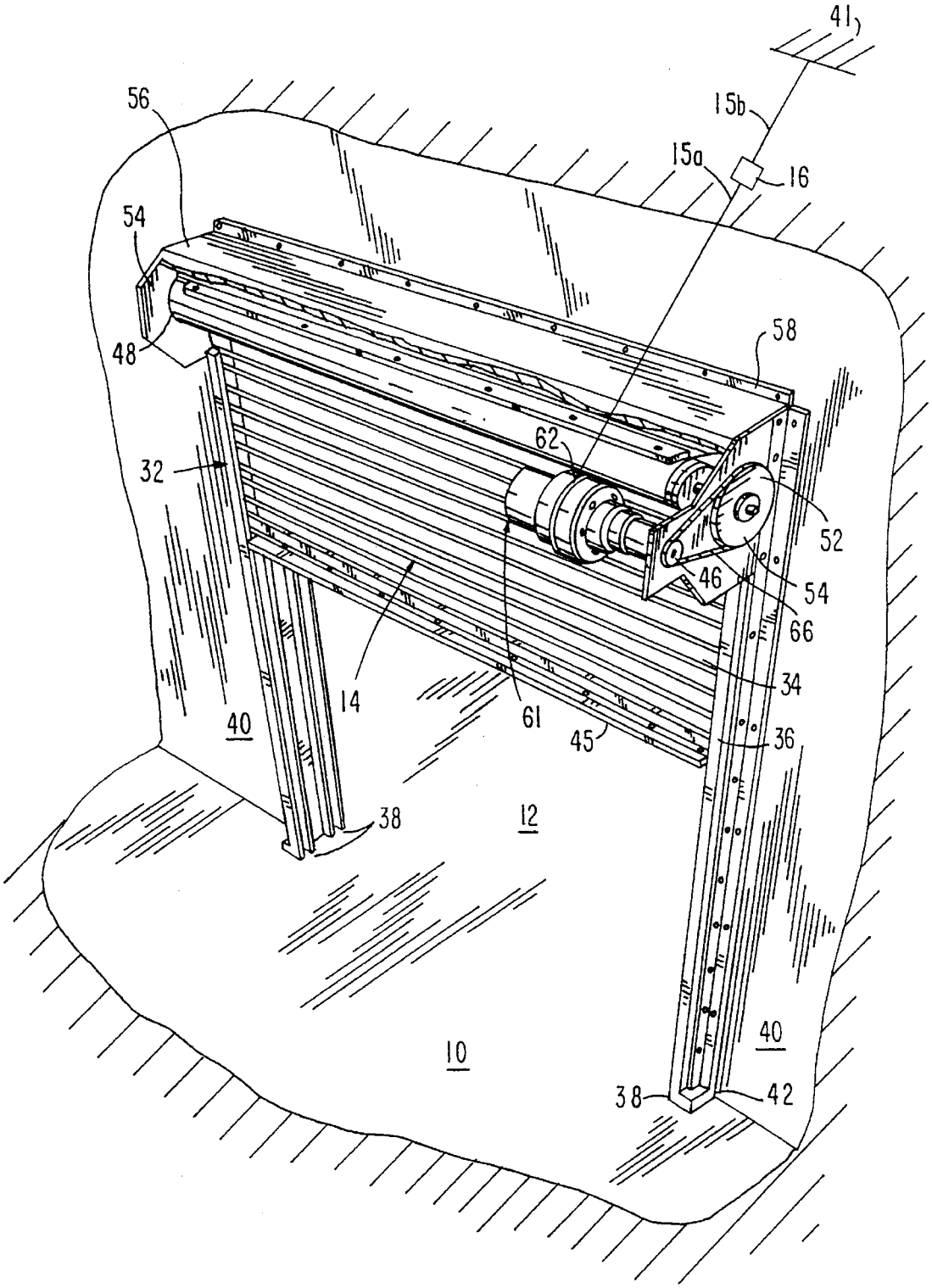
FIG. 1 is a perspective view of a fire door assembly on one side of a wall opening, the assembly including a rolling fire door, a fusible link and a regulating mechanism which contains a release mechanism with some parts broken away in order to reveal other parts.
Figure 2:
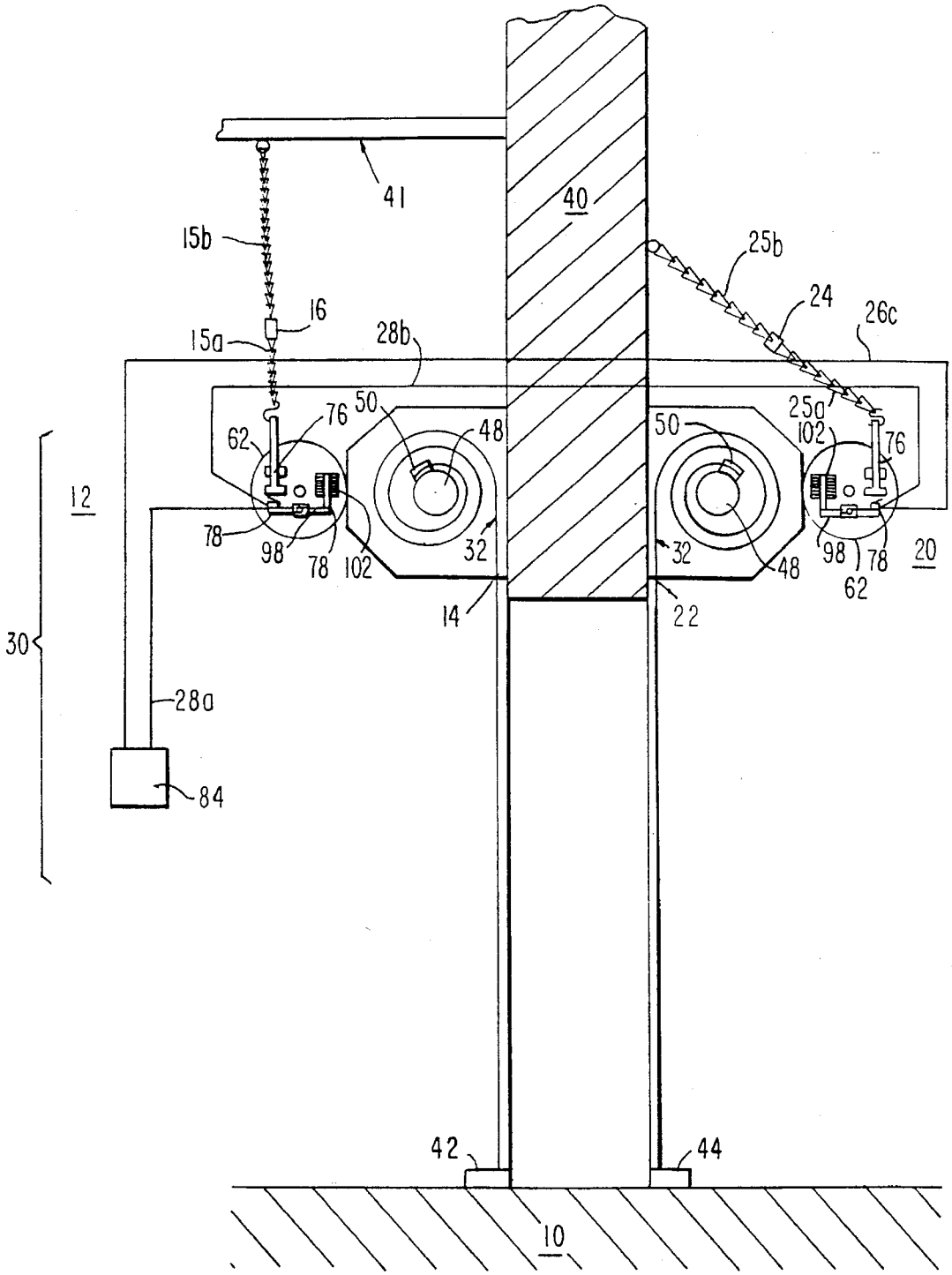
FIG. 2 is a elevational view partly in cross-section of two fire door assemblies mounted on both sides of the wall opening.

In FIGS. 1 and 2 the fire door system 10 of the present invention is shown in one face of an opening or passageway. The system 10 comprises a first fire door assembly 12 mounted to the wall 40 on the first side of the opening and a second identical fire door assembly mounted on the second side of the opening. The first fire door assembly includes a first fire door 14 which is operatively connected by a sash chain 15*a* to a first temperature sensing means 16. The temperature sensing means 16 is an element, such as a chain link cut in half and soldered together. When the ambient temperature exceeds a predetermined value, such as the melting point of the solder, the chain breaks. The first temperature sensing means 16 is also operably connected by another sash chain 15*b* to a ceiling 41 or to an upper portion. As well and as shown in FIG. 2, a second fire door assembly 20 is provided on the side of the opening opposite to that upon which the first fire door assembly is mounted and comprises a second fire door 22 operably connected by a sash chain 25*a* to a second temperature sensing means 24. Another sash chain 25*b* connects the second temperature sensing means 24 in this example, to a wall 40. As is evident, any number of fire door assemblies may be utilized with the fire door system 10.

As shown in FIG. 1, a typical fire door 14, is comprised a curtain 32 which includes a plurality of interconnected relatively pivotable horizontal slats 34, which are kept in alignment by a pair of vertical guide channels 38 which are preferably U-shaped in cross-section, vertically mounted to the wall 40 along the sides of the passageway one at each end of the horizontal slats 34. The guide channels 38 guide each end of the slats 34 to maintain slat alignment and to retain the curtain 32 when there are air currents. The slats 34 of the curtain 32 are preferably made of galvanized or stainless steel, although other fireproof or fire retardant rigid materials may be used such as, for example, materials according to Underwriters Laboratories (UL) and/or National Fire Protection Association (NFPA) requirements. The guide channels 38 are secured to the wall 40 or door frame or other structure by a mounting bracket 42. The guide channels 38 are preferably slotted to allow for heat expansion of the metal in the event of a fire to prevent the guide channels 38 from deforming and preventing the fire doors 14, 22 from operating properly. At the bottom of the bottom slat of the fire door 14, 22 is strengthened and reinforced with a bottom bar 45. Like the guide channels 38, the bottom bar 45 which is also preferably made of galvanized or stainless steel, is preferably slotted to provide for the heat expansion of the metal.

As shown in FIG. 2, the curtain 32 for each of the fire doors 14, 22 is fixed to a horizontally rotatable winding cylinder 48 on which the curtain 32 is wound and unwound when the curtain 32 is raised and lowered. Preferably, the winding cylinder 48 is a hollow barrel, tube or shaft but may also be solid. The curtain 32 is connected to the winding cylinder 48 by a starter slat 50. As shown in FIG. 1, the winding cylinder 48 is rotatably supported on its axis by two plugs 52, one inserted at each end of the winding cylinder 48. Ball bearing (not shown) are preferably mounted between the plugs 52 and the winding cylinder 48 to enable the winding cylinder 48 to rotate freely. Additionally, a spring mechanism (not shown) may be incorporated within the winding cylinder 48 to act if necessary as an additional closing means thus providing an additional force to urge the curtain 32 to close. The plugs 52 are freely attached to end plates 54 thereby supporting the winding cylinder 48. Alternatively, the plugs 52 may be an integral part of the ends of the winding cylinder 48 and may be rotatably mounted into the winding cylinder recesses in the end plates 54.

A hood 56, typically made of sheet metal, is mounted horizontally between and secured to the end plates 54 and also secured to a lintel 58 which is a horizontal member spanning and carrying the load above an opening for a fire door and usually constitutes a pan of a wall. The hood 56 encloses the curtain 32 wound about the winding cylinder 48 to act as a fire stop by closing off the space between the coiled curtain 32 and the lintel 58. The hood 56 may also include a fire baffle (not shown) formed within the hood 56 to act an additional fire stop. A temperature sensitive actuator (not shown) such as a fusible link, holds the fire baffle in a raised position until the fusible link breaks when the ambient temperature rises above a predetermined value thereby allowing the fire baffle to rotate and close the space between the top of the curtain 32 and the hood 56, thereby preventing smoke and fire from passing under the lintel 58 and over the winding cylinder 48.

As shown in FIG. 1, the present invention may be utilized in conjunction with a regulating mechanism 61 which mechanism may be mounted or attached to the right end plate 54 directly in front of the winding cylinder 48 outside of the hood 56. It will however be appreciated that the regulating mechanism 61 may also be attached to either end plate and may be placed directly in front of the winding cylinder 48, either under or outside of the hood 56 or in axial alignment with the rotatable member 48. The preferred embodiment for the means for operatively connecting the rotatable member 48 to the output shaft 46 of the regulating mechanism 61 comprises a chain drive 66. The chain drive 66 includes one or more drive sprockets (not shown) used in connection with a like number of roller chains (not shown) and may have a variety of configurations.

Figure 3:
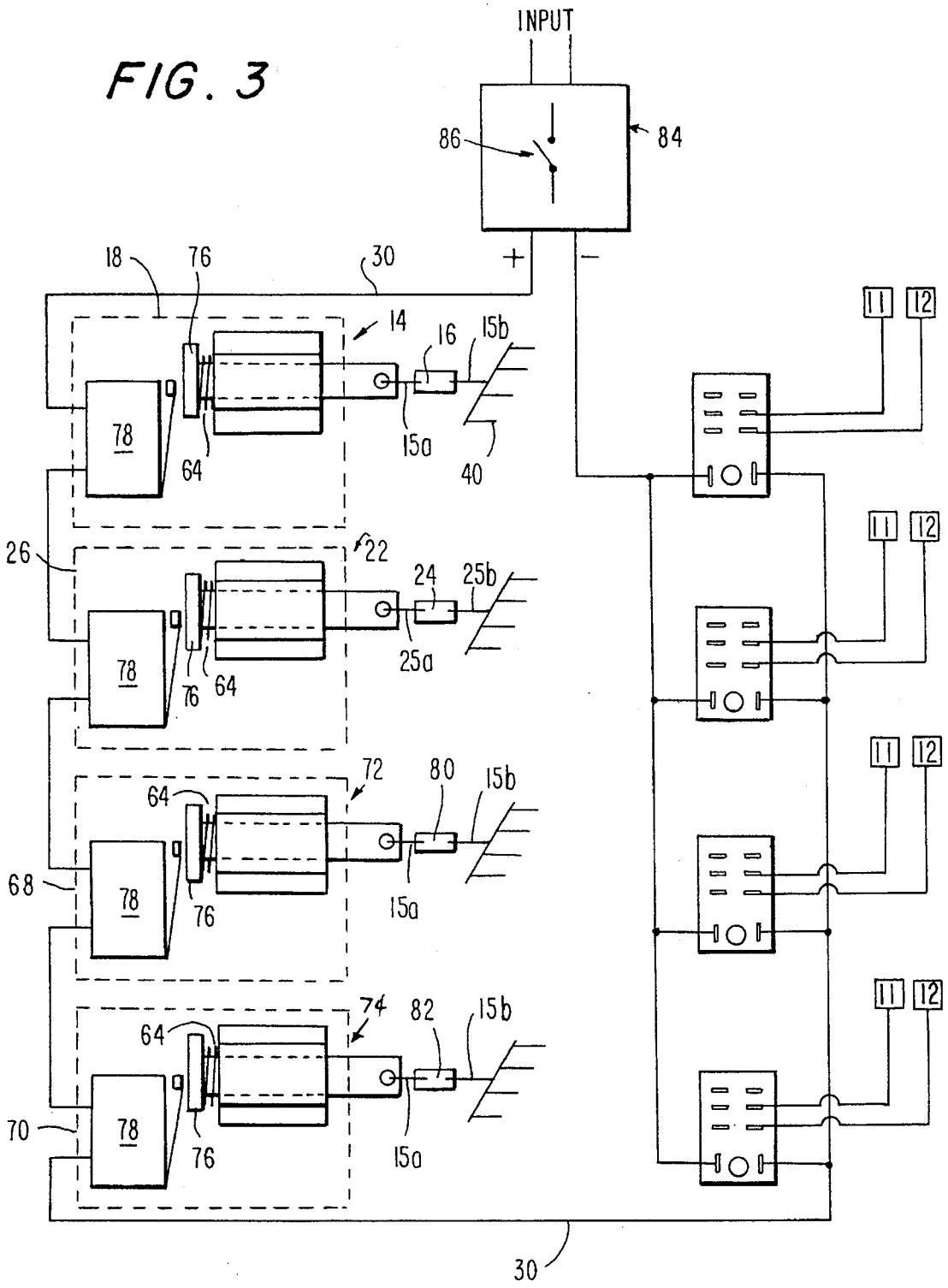
FIG. 3 is a schematic view of a circuit connecting first, second, third and fourth operators in series.
Figure 4:
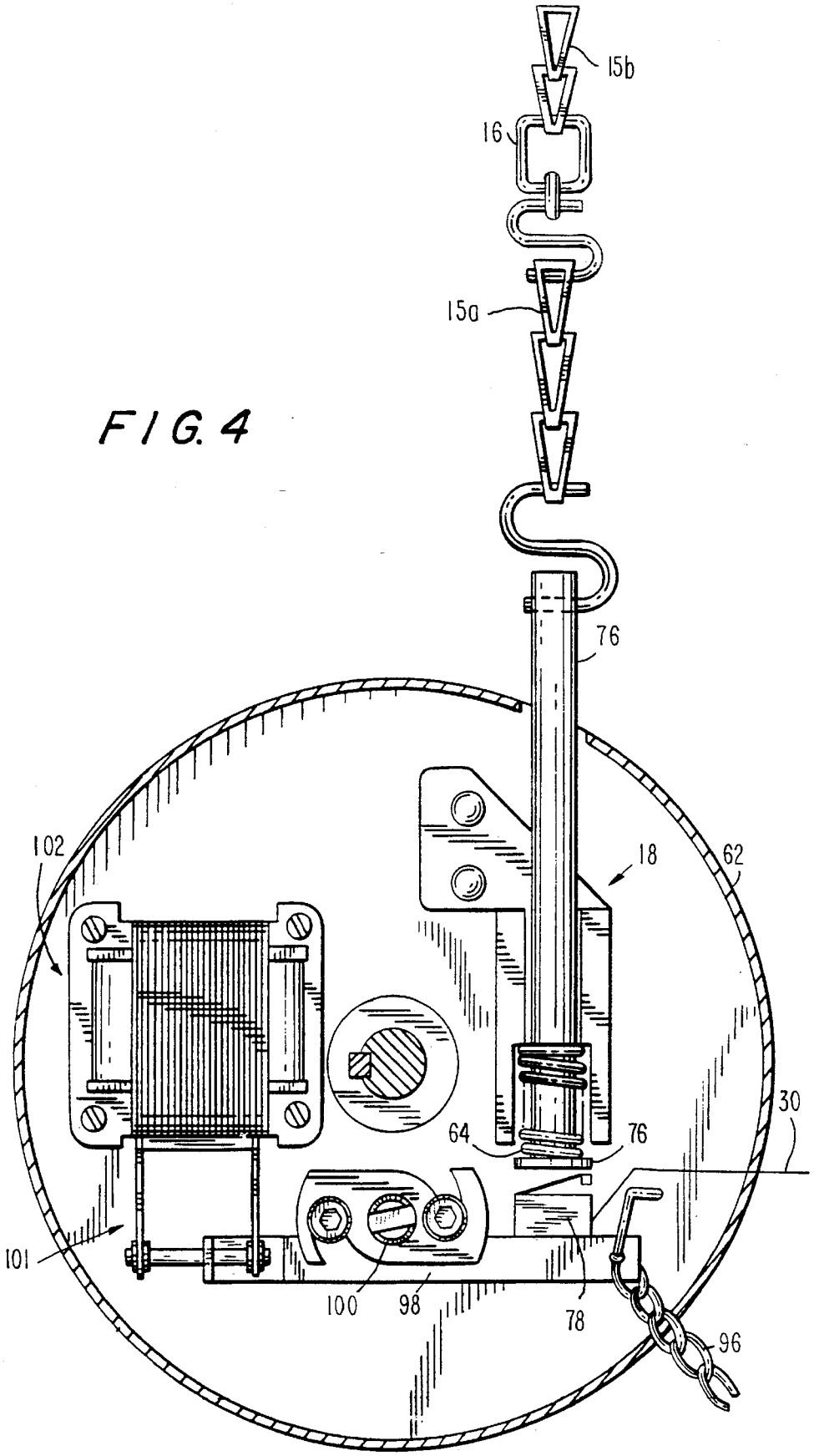
FIG. 4 is a cross-sectional view of the releasing mechanism of FIG. 1 shown in a non-contact position.

With reference now to FIGS. 2 through 4, a regulating mechanism 61 as shown in FIG. 1 typically includes a releasing mechanism 62 which releases or engages a brake (not shown) to control the release or engagement of the fire door 14. The releasing mechanism 62 includes a solenoid 102 and a shaft or lever 98, with the solenoid 102 being connected to the shaft 98 by a plunger assembly 101. As well, the releasing mechanism 62 includes an operator 18, with the operator 18 including a plunger 76 and a microswitch 78. One end of the plunger 76 is connected to a sash chain **15*a*, with the sash chain 15*a* also being connected to the temperature sensing means 16. The temperature sensing means 16 is connected to another sash chain 15*b* which in turn is connected to a wall 40 or ceiling 41. The microswitch 78 can be mounted on one end of lever 98 and is in the direct path of plunger 76. The fire door system 10 also includes a circuit means 30 for connecting the first operator 18 with the second operator 26**.

Referring to FIGS. 2 and 3, as described previously, circuit means 30 is provided for connecting the microswitches 78 of the operators such as operators 18, 26, of each fire door assembly 12, 20 such that when the fire doors 14, 22 are in an open, retracted position, the fire doors 14, 22 simultaneously move to a closed position when either the temperature sensing means 16, 24 of any of the fire door assemblies 12, 20 sense that the ambient temperature exceeds a predetermined value or if a circuit **28*b* between the operators 18, 26 is activated. Accordingly, upon interruption of this circuit 28*b* by the plunger 76 which contacts the microswitch 78 thus deactivating the circuit 28*b*, power throughout the entire circuit 30 is deactivated. As such, current to each of the solenoids 102 is interrupted, thus allowing each fire door on either side of the opening to be simultaneously closed. As shown in FIG. 2, circuit means 30 includes circuit 28*a*, which connects a test panel 84 and a first microswitch 78, circuit 28*b*, which connects the first microswitch 78 with the second microswitch 78 and circuit 28*a*, which connects the second microswitch 78 with the test panel 84**.

As shown in FIG. 3, four fire doors 14, 22, 72 and 74 can be employed which comprise the fire door system 10. Each of the fire doors 14, 22, 72 and 74 has associated with it a temperature sensing means 16, 24, 80 and 82 and a releasing mechanism 62. Contained within each releasing mechanism is an operator 18, 26, 68 and 70 which is connected to the circuit means 30. So that all the doors 14, 22, 72 and 74 may close simultaneously, the circuit means 30 preferably connects each microswitch of each operator 18, 26, 68 and 70 of all the doors 14, 22, 72 and 74 in series although each operator 28, 26, 68 and 70 may be connected in parallel.

With continued reference to FIG. 3, the test panel 84 utilizes a high voltage 220 volt transformer (not shown) connected to a diode (not shown) and is provided so that all the doors 14, 22, 72 and 74 at each opening may be tested from a single location. The test panel 84 converts the high voltage 220 volt input into a 24 volt DC output which is sent to each of the fire door operators 18, 26, 68 and 70. If the 24 volt DC signal is interrupted, i.e. power outage, alarm, manual activation of the on/off switch 86 or by activation of the microswitch 78, all the doors 14, 22, 72 and 74 which receive the signal would close under gravity.

Figure 5:
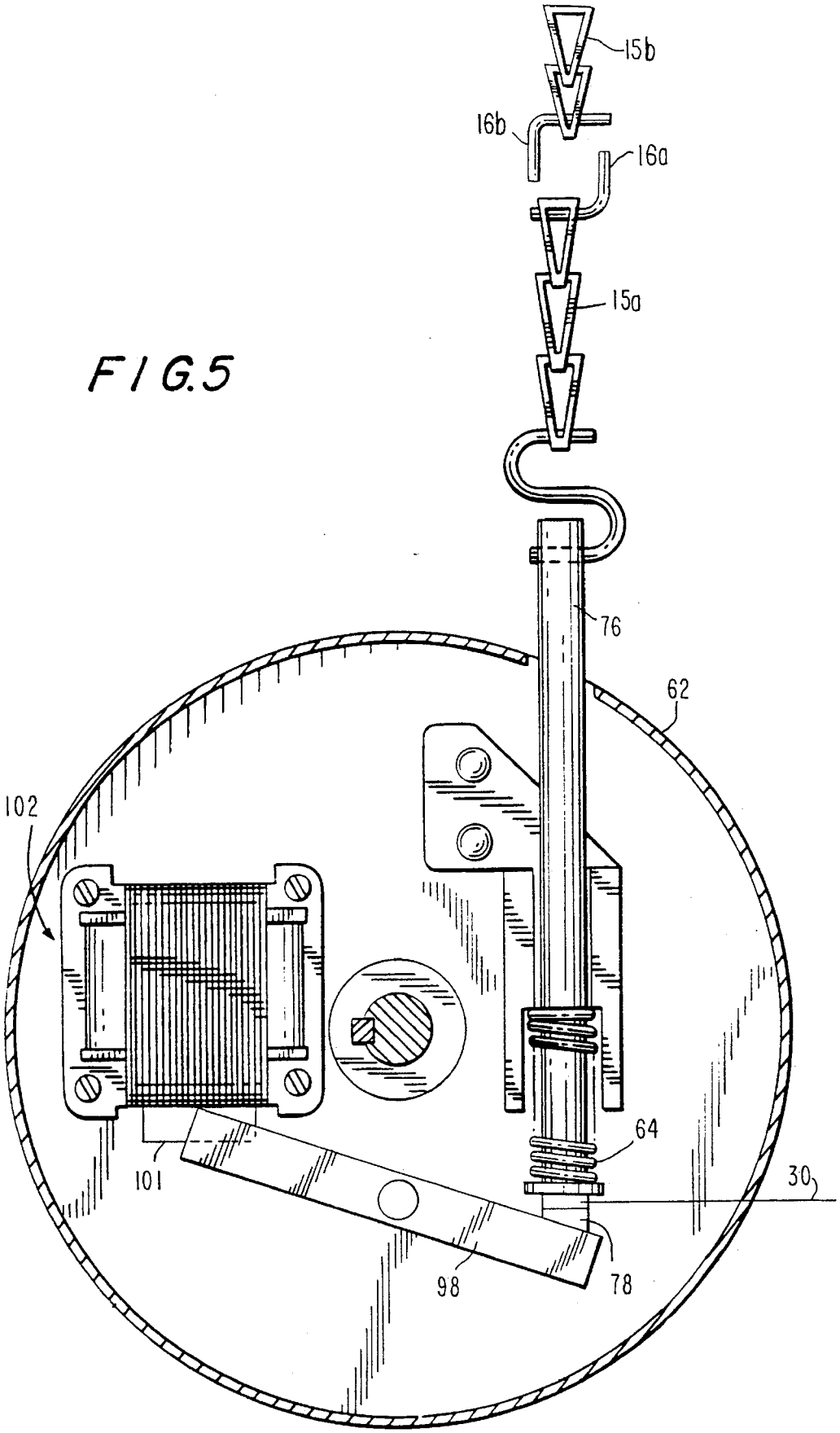
FIG. 5 is a cross-sectional view of the releasing mechanism of FIGS. 1 and 4 shown in a contact position.

Referring to the operation of the fire door system 10, all the doors 14, 22, 72 and 74 associated with the circuit means 30 may be closed when either (a) any of the temperature sensing means 16, 24, 80 and 82 on any of the doors 14, 22, 72 and 74 senses that the ambient temperature exceeds a predetermined value or (b) the circuit means 30 between any of the operators 18, 26, 68 and 70 is activated. For example, when utilizing a fire door system 10 as shown in FIG. 3, if the temperature sensing means 80 for the third fire door 72 senses that the ambient temperature exceeds a predetermined value, i.e. melts, this causes the sash chain 15*b* to no longer bias the plunger 76 in its first non-contact position. As shown in FIG. 5, the plunger 76 is caused to be biased in its second contact position, tripping a microswitch 78, thereby interrupting power throughout the circuit 30. Additionally, the plunger 76 engages lever 98, thus disengaging the brake (not shown) and allowing door number 3 to close. Most importantly, once the circuit 30 is interrupted, the solenoids 102 in all the releasing mechanisms 62 of the fire doors 14, 22 and 74 allow for the brake release thus allowing fire doors 14, 22 and 74 which are mounted on both sides of both of the first and second openings (not shown) to be closed. As well, utilizing the configuration shown on FIG. 3, if the 24 volt DC signal is interrupted, i.e. power outage, alarm, or on/off switch activation, all the doors 14, 22, 72 and 74 which receive the signal 30 would close under gravity.

Referring specifically to the temperature sensing means 16, 24, 80 and 82, this means is in the form of a fusible link or the like. The fusible link as shown in FIGS. 3, 4 and 5 comprise two pieces of metal 16*a*, 16*b* which are held together by a low melting-point solder. While the fusible link 16 is intact, a sash chain 15*a*, 15*b*, 25*a*, 25*b* pulls the plunger 76 of the operator 18, 26, 68 and 70 to compress a compression spring 64 inside the operator 18 to prevent the plunger 76 from contacting the microswitch 78. When the ambient temperature surrounding the fire door 14 reaches a predetermined value, the low melting point solder melts and the fusible link 16*a*, 16*b* separates, releasing the tension on the sash chain 15*a*, 15*b*, 25*a*, 25*b*. With this tension removed, the compression spring 64 releases the plunger 76 to engage the microswitch 78 thus interrupting power throughout the circuit means 30 as well as engage lever 98, thus disengaging the brake (not shown). Similarly, the plunger 76 of the releasing mechanism 62 engages the lever 98 to disengage the brake allowing the fire door 14 to close. Additionally and as discussed above, once the circuit means 30 of the present invention is interrupted, all fire doors 14, 22, 72 and 74 on both sides of all the openings are simultaneously closed.

Figure 6:
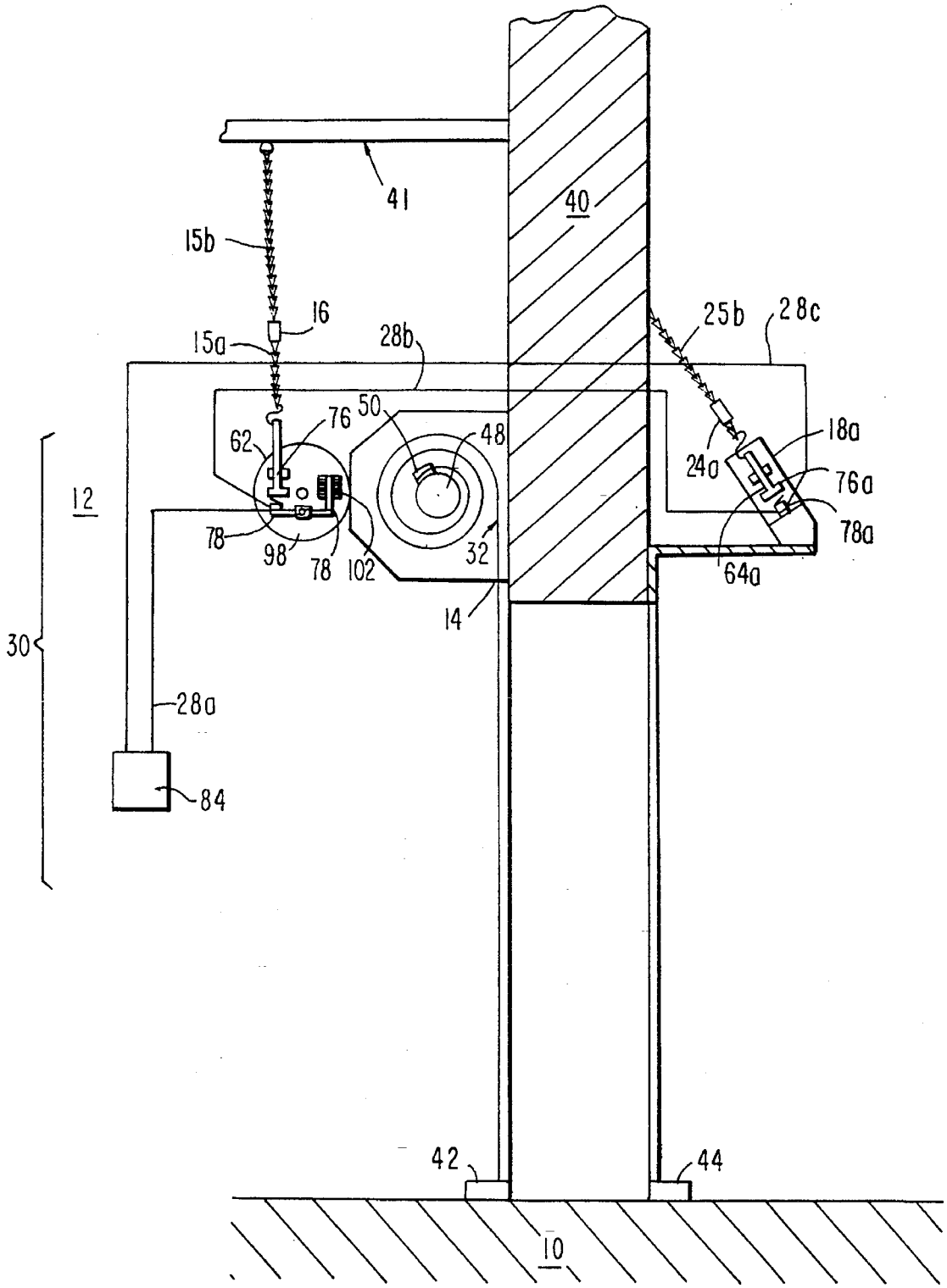
FIG. 6 is a cross-sectional view of one fire door assembly mounted on one side of the wall opening.

As shown in FIG. 6, the present invention may be utilized in conjunction with an operator 18 which includes a plunger 76 and microswitch 78 which is located opposite the fire door 14. Circuit means 30 is provided for connecting the microswitches 78, 78*a* of the operator 18 of the fire door 14 with the microswitch 78*a* opposite the fire door 14. Accordingly, upon interruption of the circuit 30 by plunger 76 or 76*a* which contacts the microswitch 78, 78*a* thus deactivating the circuit 28*b*, power throughout the entire circuit 30 is deactivated. For example, if temperature sensing means 24*a* senses that the ambient temperature exceeds a predetermined value, this causes a sash chain 25*b* to no longer bias the plunger 76*a* in its first non-contact position. The plunger 76*a* is thus caused to be biased in its second contact position, tripping microswitch 78*a*, thereby interrupting power throughout the circuit 30. Most importantly, once the circuit 30 is interrupted, the solenoids 102 and the releasing mechanism 62 of the fire door 14 allow for the break release thus allowing fire door 14 which is mounted on the first side of the first opening to be closed.

It should be understood that the preferred embodiments and examples described are for illustrative purposes only and are not to be construed as limiting the scope of the present invention which is properly delineated only in the appended claims.

What is claimed is:

1. A fire door system for simultaneously closing at least two retractable fire doors, said system comprising:

at least two fire door assemblies, each comprising a fire door having a fixed surface proximate thereto, an activatable operator connected to said fire door for closing said fire door when said operator is activated, and a temperature sensing means, each of said temperatures sensing means being connected between the fixed surface proximate said fire door and its respective activatable operator for activating said operator when a temperature exceeding a predetermined value is sensed by said temperature sensing means; and a stationary circuit connected to said activatable operators, said circuit in response to activation of one operator, activating the other operator thereby closing the fire door connected to said other operator.

2. The fire door system of claim 1, wherein each fire door assembly further comprises releasing means for regulating braking and release of a corresponding fire door as said corresponding fire door is moved to a closed position.

3. The fire door system of claim 1, wherein each operator comprises a plunger, a microswitch and tensioning means, said plunger being biased in a first non-contact position with said microswitch by said tensioning means and positionable in a second contact position relative to said microswitch when said temperature sensing means on said tensioning means senses that the ambient temperature exceeds a predetermined value, such that when said plunger is in the second contact position, the circuit means between said first and said second operators is activated, simultaneously allowing said first and second fire doors to close under the force of gravity.

4. The fire door system of claim 1, further comprising means for selectively activating said circuit means at a location remote from said first and second fire door assemblies such that said first and second fire doors are simultaneously closed.

5. The fire door system of claim 1, wherein each said temperature sensing means comprises a fusible link.

6. The fire door system of claim 1, wherein at least one of said fire doors comprises a plurality of pivotably connected horizontal slats.

7. The fire door system of claim 1, wherein said first and second operators are electrically coupled in series.

8. The fire door system of claim 1, wherein the first door assembly is securable to a first side opening of a wall for raising and lowering the first fire door disposed thereat and the second door assembly is securable to a second side opening of the wall for raising and lowering the second fire door disposed thereat.

9. The fire door system of claim 1 wherein each fire door is disposed in a separate opening.

10. The fire door system of claim 1 wherein said at least two fire doors are disposed in a common opening.

11. The fire door system of claim 1, wherein each fire door assembly further comprises a tensioning means connected between said temperature sensing means and the respective fixed surface proximate said fire doors so that when one of said temperature sensing means senses a temperature exceeding a predetermined value, said tensioning means connected thereto is released, causing said activatable operator connected thereto to close the corresponding fire door and signalling said other operator, via said stationary circuit, to close said other fire door.

12. A fire door system for closing a retractable fire door mounted in an opening, the opening having first and second sides, said system comprising:

a fire door assembly mounted on a first side of an opening, said assembly comprising a fire door, a first activatable operator connected to said fire door for closing said fire door when said operator is activated, and a temperature sensing means connected between a fixed surface and said operator for activating said operator when a temperature exceeding a predetermined value is sensed by said temperature sensing means;

a second operator distally mounted relative to said fire door assembly;

a second temperature sensing means being operably connected to said second operator; and a stationary circuit connected between the first and second operators such that when said fire door is in an opened retracted position, said fire door moves to a closed position when either of the temperature sensing means senses that the ambient temperature exceeds a predetermined value, or when the circuit means is deactivated.

13. The fire door system of claim 12, wherein said second temperature sensing means and said second operator are disposed on a second side of the opening and wherein said second operator comprises a plunger, a microswitch and a tensioning means, said plunger being biased in a first non-contact position relative to said microswitch by said tensioning means and moveable to the second contact position relative to said microswitch when said second temperature sensing means senses that the ambient temperature exceeds a predetermined value, so that said stationary circuit means activates said first operator for closing said fire door.

* * * * *